US011434936B2

(12) United States Patent
Ziemens

(10) Patent No.: US 11,434,936 B2
(45) Date of Patent: Sep. 6, 2022

(54) HYDRAULIC SYSTEM AND METHOD FOR CONTROLLING A HYDRAULIC SYSTEM

(71) Applicant: Putzmeister Engineering GmbH, Aichtal (DE)

(72) Inventor: Christian Ziemens, Aichtal (DE)

(73) Assignee: Putzmeister Engineering GmbH, Aichtal (DE)

( * ) Notice: Subject to any disclaimer, the term of this patent is extended or adjusted under 35 U.S.C. 154(b) by 0 days.

(21) Appl. No.: 17/262,851

(22) PCT Filed: Jul. 25, 2019

(86) PCT No.: PCT/EP2019/070012
§ 371 (c)(1),
(2) Date: Jan. 25, 2021

(87) PCT Pub. No.: WO2020/020997
PCT Pub. Date: Jan. 30, 2020

(65) Prior Publication Data
US 2021/0190103 A1 Jun. 24, 2021

(30) Foreign Application Priority Data
Jul. 25, 2018 (DE) ..... 10 2018 117 949.9

(51) Int. Cl.
*F15B 11/16* (2006.01)
*F15B 11/17* (2006.01)
*F15B 21/08* (2006.01)

(52) U.S. Cl.
CPC ..... *F15B 11/161* (2013.01); *F15B 11/162* (2013.01); *F15B 11/163* (2013.01); (Continued)

(58) Field of Classification Search
CPC ..... F15B 11/161; F15B 11/162; F15B 11/163; F15B 11/165; F15B 11/17; F15B 21/08
See application file for complete search history.

(56) References Cited

U.S. PATENT DOCUMENTS 3,987,623 A * 10/1976 Bianchetta ..... F15B 11/162 60/486
4,369,625 A * 1/1983 Izumi ..... E02F 9/2242 414/699

(Continued)

FOREIGN PATENT DOCUMENTS

DE 19603899 A1 8/1997
DE 102008008102 A1 8/2009

(Continued)

OTHER PUBLICATIONS

German Examination Report for Application No. 10 2018 117 949.9 filed Jul. 25, 2018 dated Apr. 3, 2019; 2 pgs.

(Continued)

*Primary Examiner* — Michael Leslie
(74) *Attorney, Agent, or Firm* — Alix, Yale & Ristas, LLP

(57) ABSTRACT

A hydraulic system having a hydraulic pump, having a plurality of hydraulic loads and having a plurality of load-sensing valves for adjusting the pump performance of the hydraulic pump. An association unit is arranged between the hydraulic pump and the hydraulic loads and in a first switched state defines a first hydraulic path between the hydraulic pump and the hydraulic loads and in a second switched state defines a second hydraulic path between the hydraulic pump and the hydraulic loads. The system comprises a controller, which processes a state value of a hydraulic load as an input variable and which determines a control signal for the switched state of the association unit. The invention also relates to a method for controlling a hydraulic system.

13 Claims, 3 Drawing Sheets

(52) U.S. Cl.
CPC ..... *F15B 11/165* (2013.01); *F15B 11/17* (2013.01); *F15B 21/08* (2013.01); *F15B 2211/20576* (2013.01); *F15B 2211/30595* (2013.01); *F15B 2211/31547* (2013.01); *F15B 2211/6057* (2013.01); *F15B 2211/71* (2013.01)

(56) References Cited

U.S. PATENT DOCUMENTS

| | | | | | |
|---|---|---|---|---|---|
| 5,259,738 | A * | 11/1993 | Salter | F04B 49/065 | 417/270 |
| 5,456,581 | A * | 10/1995 | Jokela | F04B 49/065 | 417/315 |
| 7,487,707 | B2 * | 2/2009 | Pfaff | F15B 13/0433 | 91/437 |
| 9,963,856 | B2 * | 5/2018 | Takahashi | F15B 11/165 | |
| 10,161,423 | B2 * | 12/2018 | Rampen | F15B 11/162 | |
| 10,215,198 | B2 * | 2/2019 | Takahashi | E02F 9/2267 | |
| 11,111,651 | B2 * | 9/2021 | Shimizu | E02F 9/2246 | |
| 11,118,328 | B2 * | 9/2021 | Shimizu | F15B 11/0423 | |
| 2008/0072749 | A1 | 3/2008 | Pfaff et al. | | |

FOREIGN PATENT DOCUMENTS

| | | | |
|---|---|---|---|
| DE | 102009050007 | A1 | 5/2011 |
| WO | 2008009950 | A1 | 1/2008 |

OTHER PUBLICATIONS

PCT International Research Report and Written Decision for International file No. PCT/EP2019/070012 filed Jul. 25, 2019, dated Oct. 23, 2019, 6 pgs.

* cited by examiner

HYDRAULIC SYSTEM AND METHOD FOR CONTROLLING A HYDRAULIC SYSTEM

BACKGROUND

The invention relates to a hydraulic system having a plurality of hydraulic consumers and having a plurality of load-sensing valves for setting the pumping capacity of the hydraulic pump. The invention further relates to a method for controlling a hydraulic system.

In a hydraulic system of this kind, the delivery pressure of the hydraulic pump is set at a value greater than the maximum current load pressure required by one of the hydraulic consumers under the control of the load-sensing valves. For consumers with a lower current load pressure, the hydraulic pressure is reduced by pressure-maintaining valves.

The pressure reduction means that capacity is lost in the form of so-called compensation losses. The compensation losses are particularly pronounced when consumers with a low volume flow requirement and high load pressure and consumers with a high volume flow requirement and low load pressure are combined with one another in the hydraulic system.

The problem addressed by the invention is that of introducing a hydraulic system and an associated method, so that the compensation losses can be kept smaller. Starting from the aforementioned prior art, the problem is solved using the features of the independent claims. Advantageous embodiments are indicated in the dependent claims.

SUMMARY OF THE INVENTION

In the case of the hydraulic system according to the invention, an allocation unit is arranged between the hydraulic pump and the hydraulic consumers, which allocation unit defines a first hydraulic path between the hydraulic pump and the hydraulic consumers in a first switching state and a second hydraulic path between the hydraulic pump and the hydraulic consumers in a second switching state. The system comprises a controller which processes a state value of a hydraulic consumer as an input variable and which determines a control signal for the switching state of the allocation unit.

The invention has recognized that by means of a controller of the allocation unit which depends on the current state of the hydraulic consumers, it is possible for the hydraulic paths between the hydraulic pump and the hydraulic consumers to be selectively adapted to requirements.

A state value of a hydraulic consumer is a variable which represents the current operating state of the hydraulic consumer. In particular, the state value may relate to the current load pressure of the hydraulic consumer.

Taking account of the state value, the controller can determine a control signal for the switching state of the allocation unit. The control signal can be transmitted to the allocation unit. The allocation unit can be set to a switching state that corresponds to the control signal.

A hydraulic path denotes a path via which a hydraulic consumer is supplied by a hydraulic pump. A hydraulic path within the meaning of the invention generally extends from a hydraulic pump via a load-sensing valve to a hydraulic consumer. A load-sensing valve has the function of setting the pumping capacity of the hydraulic pump depending on the current operating state of the hydraulic consumers. In particular, the load-sensing valve may be designed to set the delivery pressure of the hydraulic pump to a value which is greater by a predefined pressure difference than the maximum load pressure of a consumer supplied by the hydraulic pump. The load-sensing valves may be configured as proportional valves. It is also possible for the plurality of load-sensing valves to comprise one or multiple proportional valves and/or one or multiple constant flow valves (flow control valves).

In one embodiment, the allocation unit is arranged between a plurality of load-sensing valves and a plurality of hydraulic consumers. The switching states of the allocation unit can be defined in such a manner that in the first switching state a first hydraulic consumer is supplied by a first load-sensing valve and in the second switching state a second hydraulic consumer is supplied by the first load-sensing valve. This may apply to any combinations of load-sensing valves and hydraulic consumers.

The allocation unit may be configured in such a manner that in the first switching state a first group of hydraulic consumers is supplied by a first load-sensing valve and in the second state a second group of hydraulic consumers is supplied by the first load-sensing valve. The allocation unit and/or the controller may be configured in such a manner that any group of hydraulic consumers can be assigned at random to each load-sensing valve. It is also possible for certain allocations to be allowed, while other allocations are precluded from the outset. In a preferred embodiment, the allocation unit is set up in such a manner that a load-sensing valve in each switching state supplies precisely one hydraulic consumer. There is therefore a first switching state of the allocation unit, in which a load-sensing valve supplies precisely one first hydraulic consumer, and a second switching state, in which the load-sensing valve supplies precisely one second hydraulic consumer.

The switching states of the allocation unit can be defined in such a manner that each hydraulic consumer is supplied by precisely one load-sensing valve. It is also possible for one or multiple hydraulic consumers to be supplied by a load-sensing valve in a first switching state and by more than one load-sensing valve in a second switching state. The connection of multiple load-sensing valves to a hydraulic consumer may be sensible if a load-sensing valve which supplies a volume flow sufficient for routine operating states of the hydraulic consumer has been allocated to a hydraulic consumer beforehand. By connecting a second load-sensing valve to the hydraulic consumer, the operating speed of the hydraulic consumer can be increased temporarily. In other words, the volume flow supplied to a hydraulic consumer can be increased while the valve size remains the same and/or the individual load-sensing valve can be made smaller, wherein the volume flow is temporarily increased by connecting a second load-sensing valve.

If the hydraulic consumer is used to fold a boom of a concrete pump, for example, the normal operating speed can be defined by the fact that when the boom is extended, the tip of the boom should not exceed a particular speed. By connecting a second load-sensing valve to the hydraulic consumer, when the boom is folded in, a higher operating speed can be facil-itated.

The hydraulic system according to the invention may comprise more than one hydraulic pump. Each hydraulic pump may be allocated precisely one load-sensing valve.

If the hydraulic system comprises more than one hydraulic pump, the invention opens up the possibility of a particular hydraulic consumer being temporarily supplied by a first hydraulic pump and temporarily by a second hydraulic pump. With the allocation unit according to the invention, a changeover can be made between the hydraulic paths in a suitable manner. In particular, the allocation unit may be designed in such a manner that the hydraulic consumers are assigned to the hydraulic pumps in groups, wherein the composition of the groups may vary depending on the switching state of the allocation unit.

In one embodiment of the invention, an allocation unit within the meaning of the invention is arranged between a plurality of hydraulic pumps and a plurality of load-sensing valves. The allocation unit may be provided, in addition or alternatively to the allocation unit, between the plurality of load-sensing valves and the plurality of hydraulic consumers. The different possibilities for hydraulic paths in the allocation unit correspond to the aforementioned possibilities.

If the hydraulic system comprises only one allocation unit between the load-sensing valves and the hydraulic consumers, but no allocation unit between the hydraulic pumps and the load-sensing valves, the possibility emerges of more than one hydraulic pump being temporarily connected to a hydraulic consumer. A corresponding effect can also be achieved if an allocation unit is only arranged between the hydraulic pumps and the load-sensing valves, but not between the load-sensing valves and the hydraulic consumers. If the hydraulic system comprises a first allocation unit which is arranged between the load-sensing valves and the consumers, and a second allocation unit which is arranged between the pumps and the load-sensing valves, the hydraulic paths between the hydraulic pump and the consumers can be particularly flexible in design.

The controller of the hydraulic system can be set up in such a manner that with the help of the state values of the hydraulic consumers it forms a first group of hydraulic consumers and a second group of hydraulic consumers. A group within the meaning of the invention may consist of individual hydraulic consumers. The groups may, for example, be defined in that with all hydraulic consumers in the first group the current load pressure lies below a threshold value, while with all hydraulic consumers in the second group the current load pressure lies above the threshold value. If the hydraulic consumers are sorted by load level and allocated to the hydraulic pumps, the compensation losses can be kept small. The composition of the groups can be dynamically adjusted depending on the current operating states of the hydraulic consumers. The controller can continuously check the operating state of the hydraulic consumers to this end and produce a control signal, where necessary, by means of which the switching state of the allocation unit is changed.

The controller may be designed to set the threshold value as a function of the operating state of the hydraulic consumers. For example, the load pressures of the hydraulic consumers can be observed in ascending order and the threshold value positioned between those adjacent load pressures which are spaced furthest apart from one another. If there is a subdi-vision into more than two groups, the threshold values can be positioned in the next smallest spacings.

In addition or alternatively, the controller can be designed to determine with the help of a suitable criterion whether load pressure oscillations occur in a hydraulic consumer. Fluc-tuations in load pressure may indicate that a mechanical oscillation has occurred in an element attached to the consumer. If an oscillation parameter is greater than a predetermined threshold value, the controller can generate a control requirement according to which the hydraulic consumer concerned is separated from other hydraulic consumers. In other words, if the allocation unit previously had a switching state in which the relevant hydraulic consumer was supplied jointly with other consumers, the allocation unit can be moved into another switching state in which the hydraulic consumer concerned is supplied by a hydraulic pump which is different from the other hydraulic consumers in the group hitherto. In this way, it is possible to prevent oscillations from being transmitted from one hydraulic consumer to other hydraulic consumers.

As a further input variable, the controller can take account of inputs by an operator. If the operating state of the hydraulic consumers changes according to an input by the operator, this can result in the previous switching state of the allocation unit no longer being optimal. The controller can process the operator input, in order to determine a new control requirement for the allocation unit. In a corresponding manner, the controller can process information on the global operating state of the hydraulic system as an input variable.

In addition to this, controller can make control requirements for the state of the load-sensing valves. In particular, the opening cross section of the load-sensing valves can be set under the control of the controller. The feedback between the load states of the hydraulic consumers and the pumping capacity of the hydraulic pump may take place on hydraulic paths. It is also possible for the load pressures to be detected electronically and for the hydraulic pumps to be electrically adjustable. The pumps can be activated by means of the controller in this case.

The consumers of the hydraulic system may, for example, be linear drives or rotational drives. The hydraulic system may be designed to drive elements of a concrete pump. The consumers of the hydraulic system may, for example, comprise a linear drive for folding a boom arm of a concrete pump and/or a rotational drive for driving a rotational movement of the boom arm. Moreover, the invention relates to a concrete pump with a plurality of hydraulic consumers in which the hydraulic consumers are elements of a hydraulic system of this kind.

Moreover, the invention relates to a method for controlling a hydraulic system in which a plurality of hydraulic consumers is supplied using a hydraulic pump and in which the pumping capacity of the hydraulic pump is set using a plurality of load-sensing valves. An allocation unit with which it is possible to switch between different hydraulic paths from the hydraulic pump to the hydraulic consumers is arranged between the hydraulic pump and the hydraulic consumers. A controller processes a state value of a hydraulic consumer as an input variable, in order to determine a control signal for the switching state of the allocation unit.

The method can be improved with further features which are described in connection with the hydraulic system according to the invention. The hydraulic system can be improved with further features which are described in connection with the method according to the invention.

BRIEF DESCRIPTION OF THE DRAWINGS

The invention is described below by way of example with reference to the attached drawings with the help of advantageous embodiments. In the drawings.

DETAILED DESCRIPTION

Figure 1:
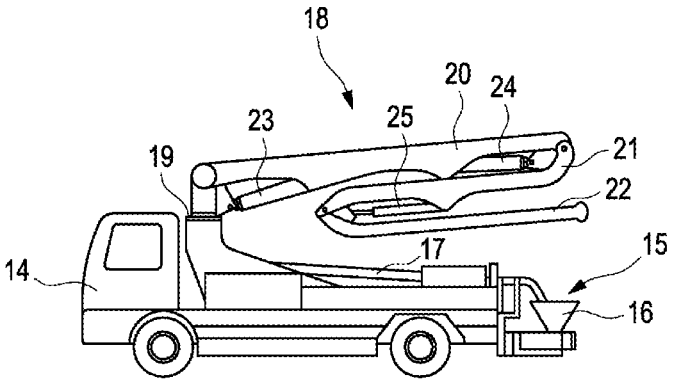
FIG. 1: shows a mobile concrete pump equipped with a hydraulic system according to the invention.
Figure 2:
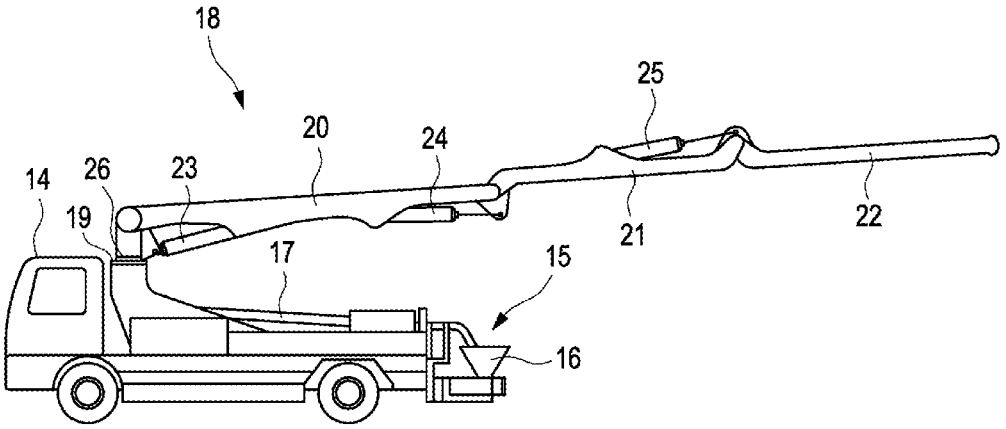
FIG. 2: shows the concrete pump according to FIG. 2 in a different state.

A truck 14 shown in FIG. 1 is equipped with a concrete pump 15 which delivers liquid concrete from a prefilling container 16 through a feed line 17. The feed line 17 extends along a boom arm 18 which is mounted rotatably on a turntable 19. The boom arm 18 comprises three boom arm segments 20, 21, 22 which are connected to one another in articulated fash-ion. By pivoting the boom arm segments 20, 21, 22 relative to one another by means of joints, the boom arm 18 can switch between a folded state (FIG. 1) and an unfolded state (FIG. 2). The feed line 17 extends to beyond the outer end of the third boom arm segment 22, so that the liquid concrete can be delivered in an area remote from the concrete pump 15.

The mobile concrete pump according to FIGS. 1 and 2 comprises a hydraulic system with at least one hydraulic pump and a plurality of hydraulic consumers. The hydraulic consumers include a first linear drive 23, a second linear drive 24, a third linear drive 25, and a rotational drive 26. Using the linear drives 23, 24, 25, the boom arm segments 20, 21, 22 can be pivoted relative to one another, in order to fold or unfold the boom arm. Using the rotational drive 26, the boom arm 18 can be rotated by means of the turntable 19 relative to the chassis of the truck 14.

The hydraulic consumers 23, 24, 25, 26 are operated by operator inputs. If the folded state of the boom arm 18 is to be changed, the corresponding input by the operator is converted into an operation of the linear drives 23, 24, 25. The same applies to a rotation of the boom arm 18 relative to the chassis.

In the prior art, the delivery pressure of the hydraulic pump is set by load-sensing valves in such a manner that it is slightly higher than the highest load pressure currently required by one of the hydraulic consumers 23, 24, 25, 26. For the remaining hydraulic consumers, the pressure is reduced by pressure-maintaining valves. The reduction in pressure results in capacity losses in the form of compensation losses which are particularly pronounced, according to FIG. 3, when individual hydraulic consumers currently require a high load pressure with a small volume flow, while with another hydraulic consumer the volume flow is high with a low load pressure.

Figure 3:
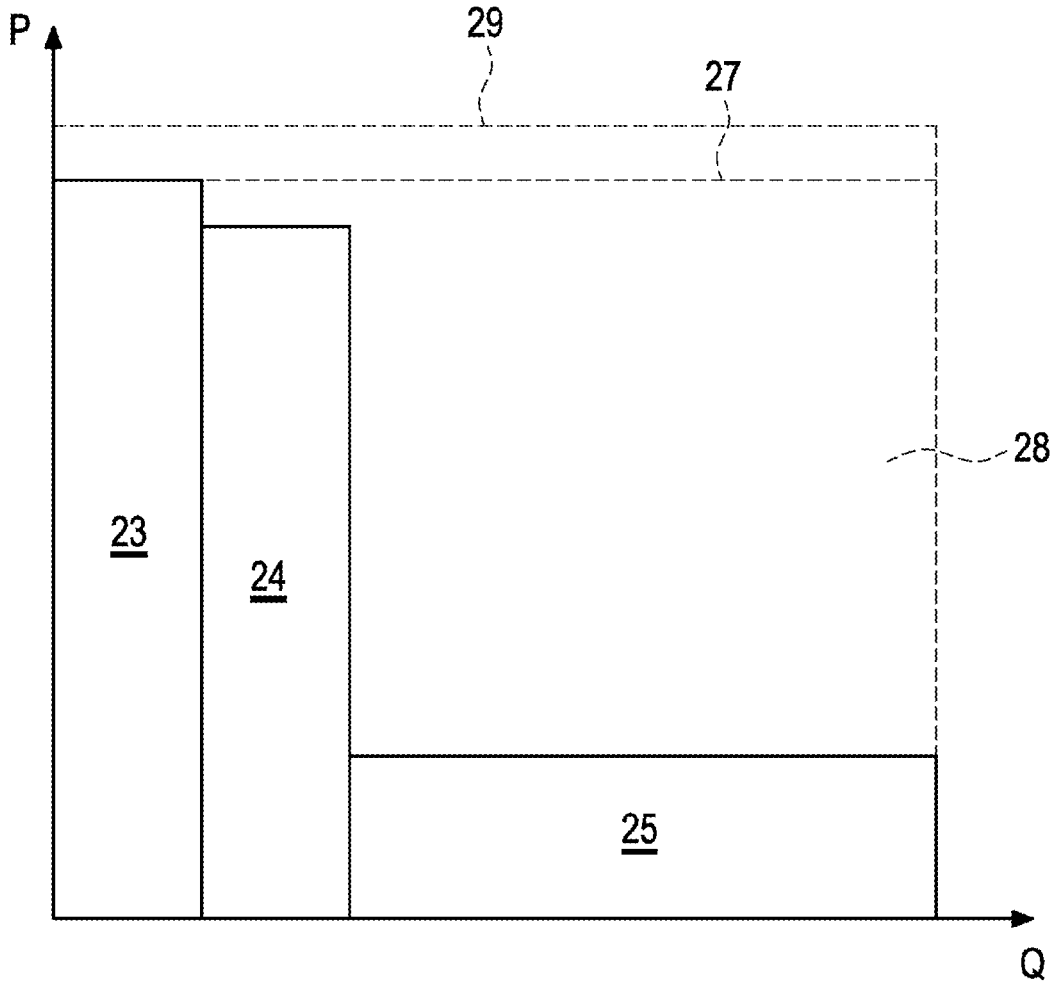
Fig. 3 PRIOR ART
FIG. 3: shows a comparative example according to the prior art.

In FIG. 3 the load pressure P is plotted against the volume flow Q for the three hydraulic consumers 23, 24, 25 for a particular time. In the case of the hydraulic consumers 23, 24, the load pressure P is high and the volume flow Q is low. In the case of the hydraulic consumer 25, the load pressure P is low and the volume flow Q is high. An unavoidable capacity loss in the hydraulic system results from the fact that the delivery pressure 29 of the hydraulic pump is slightly higher than the highest load pressure 27 which is required by the hydraulic consumer 23 in this case. The compensation loss 28 which results through the throttling of the load pressure 27 to the load pressure of the hydraulic consumer 25 is substantially greater. The compensation losses may be kept smaller in the case of the hydraulic system according to the invention.

Figure 4:
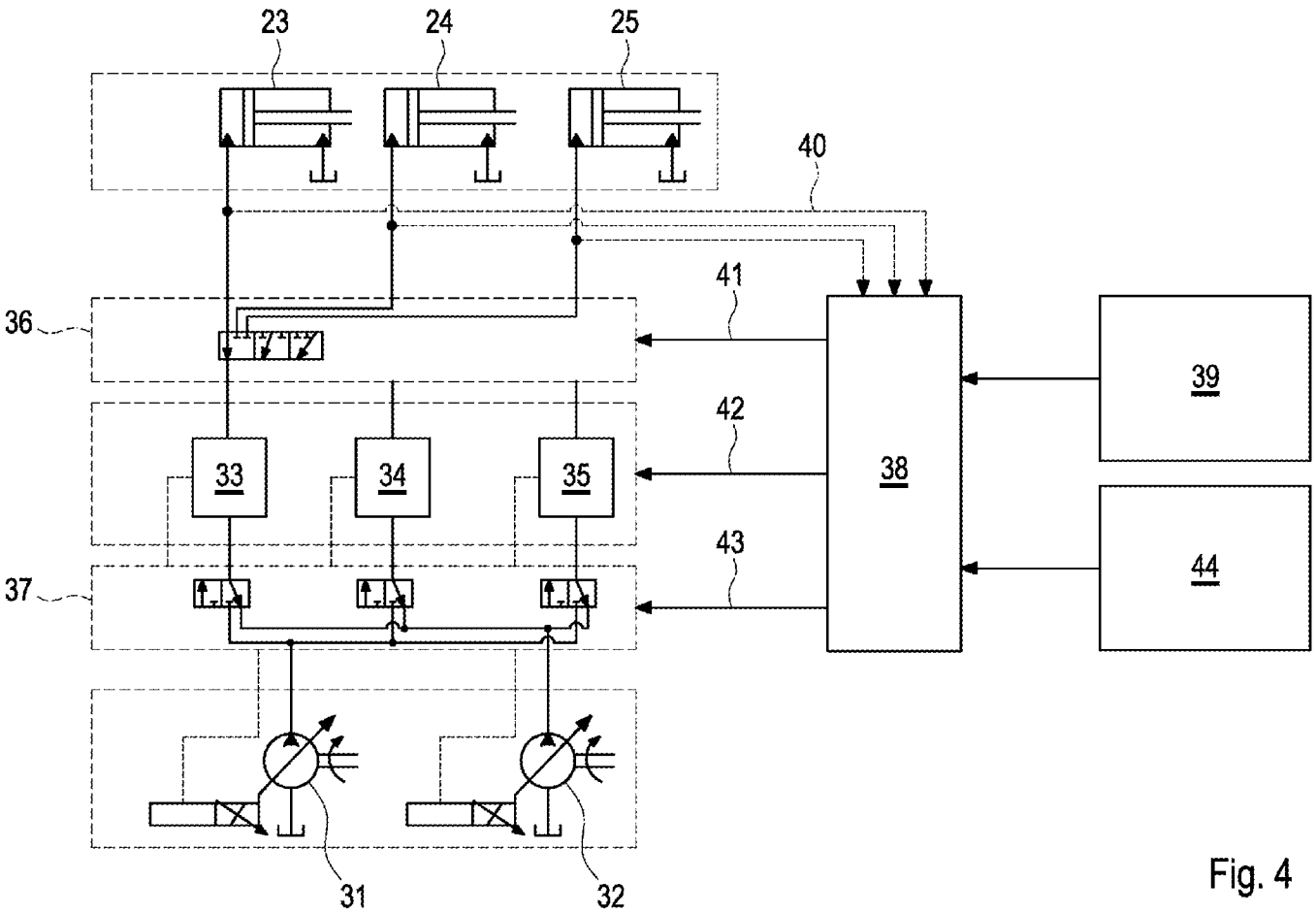
FIG. 4: shows a schematic representation of a hydraulic system according to the invention.

In the case of the exemplary embodiment shown in FIG. 4, the hydraulic system according to the invention comprises a first hydraulic pump 31 and a second hydraulic pump 32. The two hydraulic pumps 31, 32 include a regulator with which the delivery pressure of the hydraulic pumps 31, 32 is adjusted. The three linear drives 23, 24, 25 belong to the hydraulic consumers of the system. Load-sensing valves 33, 34, 35 with which the delivery pressure of the hydraulic pumps 31, 32 is adjusted to the current load pressure of the linear drives 23, 24, 25 are arranged between the hydraulic pumps 31, 32 and the hydraulic consumers 23, 24, 25. The feedback to the regulator of the hydraulic pumps 31, 32 required for this may involve hydraulic or electronic means.

A first allocation unit 36 is arranged between the load-sensing valves 33, 34, 35 and the hydraulic consumers 23, 24, 25. The allocation unit 36 comprises different switching states with which different hydraulic paths between the load-sensing valves 33, 34, 35 and the hydraulic consumers 23, 24, 25 can be made available. The switching states are defined in such a manner that each of the hydraulic consumers 23, 24, 25 can be connected to one of the load-sensing valves 33, 34, 35 individually or in arbitrary groups.

A second allocation unit 37 with which the hydraulic pumps 31, 32 and the load-sensing valves 33, 34, 35 can be connected to one another correspondingly in an arbitrary manner is arranged between the hydraulic pumps 31, 32 and the load-sensing valves 33, 34, 35.

The hydraulic system comprises a controller 38 which is coupled with a control unit 39 of the hydraulic system and a higher-level information system 44. The controller 38 receives information on the current load pressures of the hydraulic consumers 23, 24, 25 as input vari-ables via signal lines 40. Control signals can be sent to the first allocation unit 36, the load-sensing valves 33, 34, 35, and the second allocation unit 37 via control lines 41, 42, 43.

If the controller 38 receives notification via the signal lines 40 that, in accordance with the state depicted in FIG. 3, the load pressure in the case of the first and second hydraulic consumers 23, 24 is high, while the load pressure in the case of the third hydraulic consumer 25 is low, the controller 38 can form a group from the first two hydraulic consumers 23, 24 and separate the third hydraulic consumer 25 from the group. This can be converted by the controller 38 into control signals which are conducted via the control lines 41, 43 to the first allocation unit 36 and the second allocation unit 37. The allocation units 36, 37 are switched by the control signals in such a manner that the first two hydraulic consumers 23, 24 are supplied by the first hydraulic pump 31 and the third hydraulic consumer 25 is supplied by the second hydraulic pumps 32.

According to a different control approach, the controller 38 can evaluate load pressure data on oscillations received via the signal lines 40. If, for example, a state occurs in the first hydraulic consumer 23 in which the oscillation of the load pressure is greater than a predetermined threshold value, the controller 38 can form a group of the second and third hydraulic consumers 24, 25 and separate the first hydraulic consumer 23 from the group. By means of the control lines 41, 43, the allocation units 36, 37 can be activated in such a manner that the first hydraulic consumer 23 is connected to the first hydraulic pump 31 and the second and third hydraulic consumers 24, 25 are connected to the second hydraulic pump 32. By separating the first hydraulic consumer 23, the oscillations which occur in the case of this hydraulic consumer 23 are prevented from having detrimental effects on the other hydraulic consumers 24, 25.

A further control approach of the controller 38 involves determining a state in which two of the hydraulic consumers 23, 24, 25 are inoperative or only require a small capacity, while a rapid movement is required of a third hydraulic consumer. It can be seen in FIGS. 1 and 2 that when the boom arm 18 is almost completely extended, even with slow movements of the linear drives 23, 24, 25, a rapid movement of the boom tip can be produced. The load-sensing valves 33, 34, 35 may be of such dimensions that the maximum volume flow through one of the valves allows the slow movements of the linear drive 23, 24, 25 required in the extended state. By contrast, when the boom arm 18 is virtually folded in, a quicker movement of the linear drives 23, 24, 25 may be desirable. The volume flow required for this may not be supplied by one of the load-sensing valves 33, 34, 35, however. If the controller 38 establishes a state in which the first two linear drives 23, 24 are inoperative, for example, while a rapid movement is required of the third linear drive 25, it can transmit control signals to the allocation units 36, 37, according to which a further load-sensing valve is connected to the third linear drive 25. In this way, a higher operating speed for the third linear drive 25 is made possible.

In the controller 38, a plurality of control approaches can be realized in parallel. In order to avoid conflict, a hierarchy can be established between the control approaches. For example, the avoidance of oscillations can be given the highest priority. If all hydraulic consumers in the system are free of oscillations, the hydraulic consumers can be sorted into groups with the help of the current load pressures according to the next priority, in order to keep compensation losses low. In the third priority, multiple hydraulic pumps can be connected to one hydraulic consumer, in order to increase the operating speed.

The invention claimed is:

1. A hydraulic system comprising a plurality of hydraulic pumps;

a plurality of hydraulic consumers, each hydraulic consumer having a state value which represents a current operating state of the hydraulic consumer;

a plurality of load-sensing valves for setting the pumping capacity of the plurality of hydraulic pumps, said load sensing-valves having an adjustable opening cross-section;

an allocation unit arranged between the plurality of hydraulic pumps and the plurality of hydraulic consumers, which allocation unit comprising a plurality of hydraulic switches that define a first hydraulic path between the plurality of hydraulic pumps and the plurality of hydraulic consumers in a first switching state of the plurality of hydraulic switches and a second hydraulic path between the plurality of hydraulic pumps and the plurality of hydraulic consumers in a second switching state of the plurality of hydraulic switches; and a controller which processes the state value of the plurality of hydraulic consumers as an input variable and which determines a control signal for the switching state of the allocation unit, wherein said allocation unit comprises a first allocation unit with an inlet end connected to receive hydraulic fluid from the plurality of load-sensing valves and an outlet end connected to deliver hydraulic fluid to the plurality of hydraulic consumers and a second allocation unit with an inlet end connected to receive hydraulic fluid from the plurality of hydraulic pumps and an outlet end connected to deliver hydraulic fluid to the plurality of load-sensing valves.

2. The hydraulic system of claim 1, wherein the state value of a hydraulic consumer represents a current load pressure of the hydraulic consumer.

3. The hydraulic system of claim 1, wherein the controller evaluates the state values of the plurality of hydraulic consumers, to divide the hydraulic consumers into at least two groups.

4. The hydraulic system of claim 3, wherein the state value represents a current load pressure of the hydraulic consumer and the current load pressures of a first group of hydraulic consumers are lower than the current load pressures of a second group of hydraulic consumers.

5. The hydraulic system of claim 3, wherein the state value represents a current load pressure of the hydraulic consumer and load pressure oscillations of a first group of hydraulic consumers are lower than load pressure oscillations of a second group of hydraulic consumers.

6. The hydraulic system of claim 3, wherein the controller determines control requirements for the allocation units so that a first group of hydraulic consumers is supplied by a first hydraulic pump and a second group of hydraulic consumers is supplied by a second hydraulic pump.

7. The hydraulic system of claim 1, wherein the controller determines the control requirements for the allocation units so that at least one of said plurality of hydraulic consumers is supplied by more than one of said plurality of hydraulic pumps.

8. A method for controlling a hydraulic system, said method comprising:

using a plurality of hydraulic pumps to supply a plurality of hydraulic consumers, each of said hydraulic consumers having a state value representative of an operating condition of the hydraulic consumer;

providing a plurality of load-sensing valves between said plurality of hydraulic pumps and said plurality of hydraulic consumers, wherein an opening cross section of the load-sensing valves is adjustable;

arranging an allocation unit between the plurality of hydraulic pumps and the plurality of hydraulic consumers, said allocation unit comprising a plurality of hydraulic switches operatively connected to said plurality of load-sensing valves to define a first hydraulic path between the plurality of hydraulic pumps and the hydraulic consumers in a first switching state of the plurality of hydraulic switches and define a second hydraulic path between the plurality of hydraulic pumps and the plurality of hydraulic consumers in a second switching state of the plurality of hydraulic switches, said allocation unit comprising a first allocation unit having an inlet end connected to receive hydraulic fluid from the plurality of hydraulic pumps and an outlet end connected to deliver hydraulic fluid to the plurality of load-sensing valves, and a second allocation unit having an inlet end connected to receive hydraulic fluid from the plurality of load-sensing valves and an outlet end connected to deliver hydraulic fluid to the plurality of hydraulic consumers;

connecting said plurality of hydraulic consumers, first allocation unit and second allocation unit to a controller;

processing the state value of the plurality of hydraulic consumers as an input variable in said controller to determine control signals to define the switching state of the first allocation unit and the second allocation unit.

9. The method of claim 8, comprising:

evaluating the state values in the controller to divide the hydraulic consumers into at least two groups.

10. The method of claim 9, wherein the state value represents a current load pressure of the hydraulic consumer and said method comprises:

dividing the plurality of hydraulic consumers into a first group of hydraulic consumers and a second group of hydraulic consumers based upon the current load pressures of the hydraulic consumers, the current load pressures of the first group of hydraulic consumers being lower than the current load pressures of the second group of hydraulic consumers.

11. The method of claim 9, wherein the state value represents a current load pressure of the hydraulic consumer and said method comprises:

evaluating said state values in the controller to detect load pressure oscillations in the plurality of hydraulic consumers; and dividing the plurality of hydraulic consumers into a first group of hydraulic consumers and a second group of hydraulic consumers based upon pressure oscillations in the plurality of hydraulic consumers, the load pressure oscillations of the first group of hydraulic consumers being lower than the load pressure oscillations of the second group of hydraulic consumers.

12. The method of claim 9, comprising:

generating control signals in said controller to define the switching state of said first allocation unit and said second allocation unit so that the first group of hydraulic consumers is supplied by a first hydraulic pump and said second group of hydraulic consumers is fed by a second hydraulic pump.

13. The method of claim 8, comprising:

generating control signals in said controller to define the switching state of said first allocation unit and said second allocation unit so that one of said plurality of hydraulic consumers is supplied by more than one of said plurality of hydraulic pumps.

* * * * *